US010462596B2

(12) United States Patent
Chon et al.

(10) Patent No.: US 10,462,596 B2
(45) Date of Patent: Oct. 29, 2019

(54) AUDIO APPARATUS, METHOD OF PROCESSING AUDIO SIGNAL, AND A COMPUTER-READABLE RECORDING MEDIUM STORING PROGRAM FOR PERFORMING THE METHOD

(71) Applicant: Samsung Electronics Co., Ltd, Suwon-si, Gyeonggi-do (KR)

(72) Inventors: Sang-bae Chon, Suwon-si (KR); Sun-min Kim, Suwon-si (KR); Jae-ha Park, Suwon-si (KR); Hyun-min Kim, Seoul (KR); Jeong-su Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/093,678

(22) Filed: Dec. 2, 2013

(65) Prior Publication Data

US 2014/0153752 A1 Jun. 5, 2014

(30) Foreign Application Priority Data

Dec. 5, 2012 (KR) ..... 10-2012-0140581

(51) Int. Cl.
*H04S 7/00* (2006.01)

(52) U.S. Cl.
CPC ..... *H04S 7/303* (2013.01); *H04S 2400/11* (2013.01)

(58) Field of Classification Search
CPC ..... H04S 7/303; H04S 2400/11
See application file for complete search history.

(56) References Cited

U.S. PATENT DOCUMENTS 8,855,340 B2 10/2014 Yoo et al.
2004/0111171 A1* 6/2004 Jang ..... H04S 7/30 700/94
2009/0310802 A1 12/2009 Zhang et al.
2010/0135510 A1* 6/2010 Yoo ..... G10L 19/008 381/300
2011/0222693 A1* 9/2011 Lee ..... H03G 9/005 381/17

(Continued)

FOREIGN PATENT DOCUMENTS

JP 2010-258653 11/2010
KR 10-2011-0065144 6/2011

OTHER PUBLICATIONS

Ville Pulkki, "Virtual Sound Source Positioning Using Vector Base Amplitude Panning," XP 000695381, J. Audio Eng. Soc., vol. 45, No. 6, Jun. 1997, 11 pages.

(Continued)

*Primary Examiner* — Ping Lee
(74) *Attorney, Agent, or Firm* — Staas & Halsey LLP

(57) ABSTRACT

An audio apparatus and a method of processing an audio signal of the audio apparatus are provided. The method includes: receiving a main audio and an interactive audio; panning the interactive audio by using position information of a user, sound source position information of the interactive audio, and speaker position information; rendering the panned interactive audio according to a space characteristic of the main audio; and mixing and outputting the rendered interactive audio and the main audio to provide the user with a more lively interactive audio.

8 Claims, 5 Drawing Sheets

(56) References Cited

U.S. PATENT DOCUMENTS

2011/0305344 A1* 12/2011 Sole ..... G10L 19/008
381/22
2013/0329922 A1* 12/2013 Lemieux ..... H04S 3/002
381/307

OTHER PUBLICATIONS

Taejin Lee et al., "An Object-based 3D Audio Broadcasting System for Interactive Service", Audio Engineering Society Convention Paper 6384, May 2005, 8 pages.
Extended European Search Report dated Nov. 11, 2014 in European Patent Application No. 13192454.0.
Chinese Office Action dated Mar. 4, 2016 in Chinese Patent Application No. 201310652342.7.
Korean Notice of Allowance dated Jun. 28, 2019 in Korean Patent Application No. 10-2012-0140581.

* cited by examiner

AUDIO APPARATUS, METHOD OF PROCESSING AUDIO SIGNAL, AND A COMPUTER-READABLE RECORDING MEDIUM STORING PROGRAM FOR PERFORMING THE METHOD

CROSS-REFERENCE TO RELATED APPLICATIONS

This application claims priority under 35 U.S.C. § 119 from Korean Patent Application No. 10-2012-0140581, filed on Dec. 5, 2012, in the Korean Intellectual Property Office, the disclosure of which is incorporated herein by reference in its entirety.

BACKGROUND OF THE INVENTION

1. Field of the Invention

The present general inventive concept generally relates to providing an audio apparatus, a method of processing an audio signal, and a computer-readable recording medium storing a program to perform the method, and more particularly, to providing an audio apparatus which provides an interactive audio responding to a control of a user if a multimedia content is played, a method of processing an audio signal, and a computer-readable recording medium storing a program to perform the method.

2. Description of the Related Art

A conventional audio apparatus unilaterally provides audio stored in a multimedia content to a user. However, a recent audio apparatus provides a main audio stored in a multimedia content and an interactive audio generated in response to an input of a user.

For example, in the case of a game content, an audio apparatus provides a main audio stored when generating the game content, such as background music, and an interactive audio generated in response to a user control.

However, an existing audio apparatus provides an interactive audio regardless of a characteristic of a space in which a main audio is realized. For example, in the case of a shooting game content, a gunshot that is an interactive audio becomes different according to a space (e.g., an indoor or outdoor space) in which a main audio is realized. However, the existing audio apparatus provides the gunshot regardless of the space in which the main audio is realized. Therefore, since the interactive audio is provided regardless of the main audio, the user is provided with an unrealistic interactive audio having a poor liveness.

Also, the existing audio apparatus provides the interactive audio regardless of a position of a speaker and a position of a user. Therefore, the user is provided with an unrealistic interactive audio having the poor liveness due to a change of at least one of the positions of the speaker and the user.

SUMMARY OF THE INVENTION

Exemplary embodiments of the present general inventive concept address at least the above problems and/or disadvantages and other disadvantages not described above. Also, the exemplary embodiments of the present general inventive concept are not required to overcome the disadvantages described above, and an exemplary embodiment of the present general inventive concept may not overcome any of the problems described above.

Additional features and utilities of the present general inventive concept will be set forth in part in the description which follows and, in part, will be obvious from the description, or may be learned by practice of the general inventive concept.

The foregoing and/or other features and utilities of the present general inventive concept are achieved by providing an audio apparatus including an interactive audio according to a position of a user, a position of a speaker, and a characteristic of a space in which an audio is realized, in order to provide an interactive audio having a high liveness, a method of processing an audio signal, and a computer-readable recording medium storing a program to perform the method.

The foregoing and/or other features and utilities of the present general inventive concept may also be achieved by providing a method of processing an audio signal of an audio apparatus. The method may include: receiving a main audio and an interactive audio; panning the interactive audio by using position information of a user, sound source position information of the interactive audio, and speaker position information; rendering the panned interactive audio according to a space characteristic of the main audio; and mixing and outputting the rendered interactive audio and the main audio.

If the audio apparatus is realized as a plurality of speakers to output a plurality of channels having different elevation elements, the interactive audio may be panned as a 3-dimensional (3D) space having an elevation element.

The panning of the interactive audio may include: sensing the position information of the user; determining relative position information of a sound source of the interactive audio based on the user position by using the sensed position information of the user and a position of the sound source of the interactive audio; analyzing a panning coefficient of the sound source based on the user position by using the sensed position information of the user and the speaker position information; and panning the interactive audio as the 3D space having the elevation component based on the panning coefficient of the sound source according to the relative position information of the sound source of the interactive audio.

If the audio apparatus is realized as a plurality of speakers for outputting a plurality of channels having the same elevation elements, the interactive audio may be panned to have a virtual elevation component.

When receiving the main audio and the interactive audio, space information of the main audio may be received together. The panned interactive audio may be rendered by using the space information of the main audio.

The space information of the main audio may be an impulse response or a transfer function.

The paned interactive audio may be rendered according to a space characteristic of the main audio which is determined by analyzing the main audio.

The foregoing and/or other features and utilities of the present general inventive concept may also be achieved by providing an audio apparatus including: an input device to receive a main audio and an interactive audio; a panning device to pan the interactive audio by using position information of a user, position information of a sound source of the interactive audio, and speaker position information; a renderer to render the panned interactive audio according to a space characteristic of the main audio; and an output device to mix and output the rendered interactive audio and the main audio.

If the audio apparatus is realized as a plurality of speakers to output a plurality of channels having different elevation elements, the panning device may pan the interactive audio as a 3D space having an elevation element.

The panning device may include: a user position sensor to sense the position information of the user; a relative position information determiner to determine relative position information of the sound source of the interactive audio based on the user position by using the position information of the user sensed by the user position sensor and a position of the sound source of the interactive audio; a panning coefficient analyzer to analyze a panning coefficient of the sound source based on the user position by using the position information of the user and the speaker position information; and a 3D panning device to pan the interactive audio as the 3D space having the elevation component based on the panning coefficient of the sound source according to the relative position information of the sound source of the interactive audio.

If the audio apparatus is realized as a plurality of speakers to output a plurality of channels having the same elevation elements, the panning device may pan the interactive audio so that the interactive audio has a virtual elevation component.

The input device may receive space information of the main audio. The renderer may render the panned interactive audio by using the space information of the input main audio.

The space information of the main audio may be an impulse response or a transfer function.

The renderer may include a space characteristic determiner to analyze the main audio to determine the space characteristic of the main audio. The renderer may render the panned interactive audio according to the space characteristic of the main audio determined by the space characteristic determiner.

The foregoing and/or other features and utilities of the present general inventive concept may also be achieved by providing a computer-readable recording medium storing a program to perform the method.

The foregoing and/or other features and utilities of the present general inventive concept may also be achieved by providing an audio apparatus comprising: a panning device to pan interactive audio in a three dimensional (3D) space using relative position information of a sound source and a panning coefficient table based on a user position; a renderer device to render the panned interactive audio by using space information of a main audio; and an output device to mix and output the rendered interactive audio and the main audio.

The audio apparatus may further comprise an input device to receive the main audio and the interactive audio, to transmit the main audio to the renderer device and the output device, and to transmit the interactive audio to the panning device.

The renderer device may comprise a storage device to receive and store the space information of the main audio, and a sound field renderer device to render the interactive audio by using the space information of the main audio stored in the storage device.

The renderer device may comprise a space characteristic determiner device to analyze a space characteristic of the main audio to determine the space information of the main audio, to generate an ambience index or an impulse response corresponding to the ambience index based on the determined space information of the main audio, and a sound field renderer device to reflect the space information of the main audio to render the panned interactive audio.

The foregoing and/or other features and utilities of the present general inventive concept may also be achieved by providing a method of processing an audio signal comprising: panning an interactive audio in a three dimensional (3D) space using relative position information of a sound source and a panning coefficient table based on a user position; rendering the panned interactive audio by using space information of a main audio; and mixing and outputting the rendered interactive audio and the main audio.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
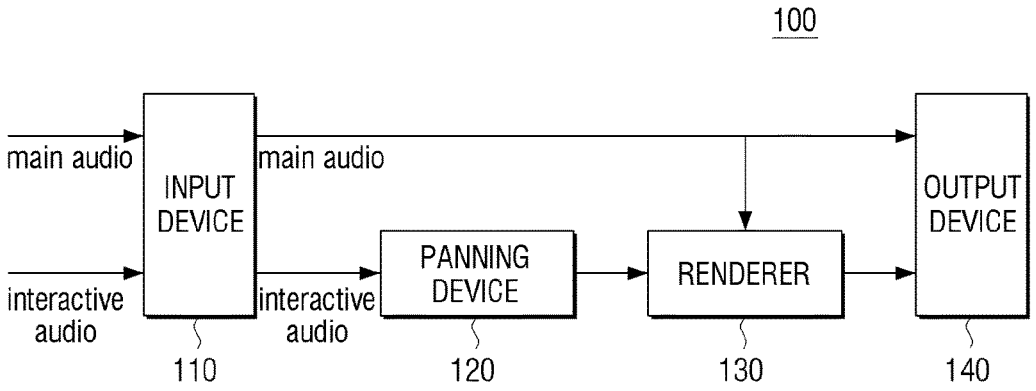
FIG. 1 is a schematic block diagram illustrating a structure of an audio apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

In the following description, the same drawing reference numerals are used for the same elements even in different drawings. The matters defined in the description, such as detailed construction and elements, are provided to assist in a comprehensive understanding of the exemplary embodiments of the present general inventive concept. Thus, it is apparent that the exemplary embodiments of the present general inventive concept can be carried out without those specifically defined matters. Also, well-known functions or constructions are not described in detail since they would obscure the exemplary embodiments of the present general inventive concept with unnecessary detail.

FIG. 1 is a schematic block diagram illustrating a structure of an audio apparatus 100 according to an exemplary embodiment of the present general inventive concept. Referring to FIG. 1, the audio apparatus 100 includes an input device 110, a panning device 120, a renderer 130, and an output device 140.

The input device 110 receives a main audio and an interactive audio. Here, the main audio may be an audio which is output regardless of a user command when executing a multimedia content, and the interactive audio may be an audio which is output in response to a user input when executing the multimedia content. For example, if the multimedia content is a game content, the main audio may be a background music which is output when playing a game, and the interactive audio may be a sound effect (e.g., a gunshot or the like) which is output in response to a user input. After receiving the main audio and the interactive audio, the input device 110 transmits the main audio to the renderer 130 and the output device 140 and transmits the interactive audio to the panning device 140.

The panning device 120 pans the interactive audio input through the input device 110 by using position information of a user, sound source position information, and speaker position information of the interactive audio. Here, if the audio apparatus 100 is realized as a plurality of speakers to output a plurality of channels having different elevation elements, the panning device 120 pans the interactive audio into a 3-dimensional (3D) space having a high level component.

Figure 2:
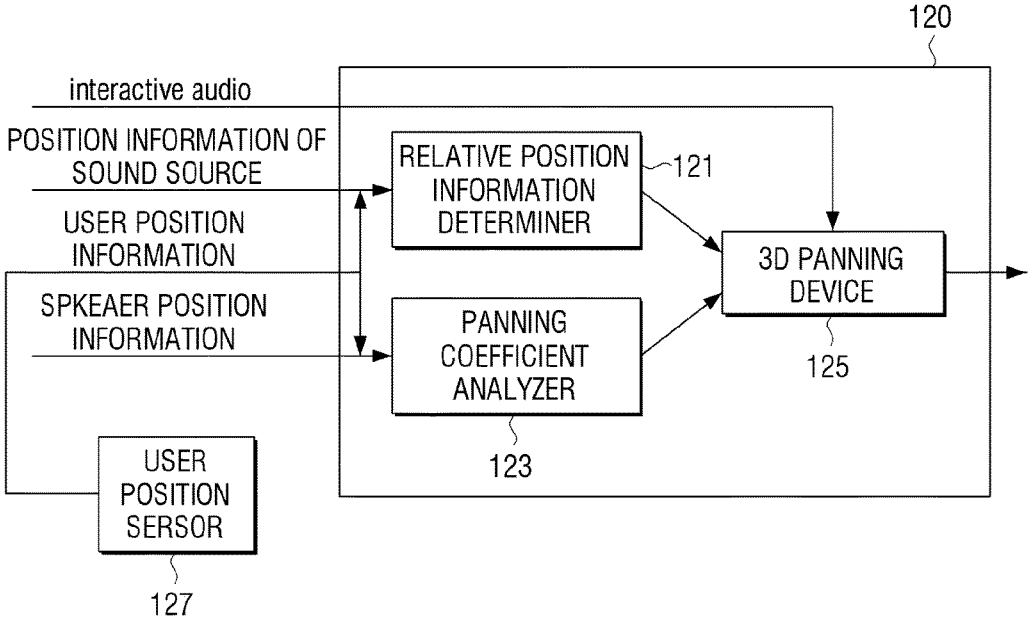
FIG. 2 is a block diagram illustrating a structure of a panning device according to an exemplary embodiment of the present general inventive concept.

The panning device 120 will now be described in more detail with reference to FIG. 2. Referring to FIG. 2, the panning device 120 includes a relative position information determiner 121, a panning coefficient analyzer 123, and a 3D panning device 125. The panning device 120 receives interactive audio data, sound source position information of interactive audio, user position information, and speaker position information, as shown in FIG. 2. The panning device 120 receives the interactive audio data and the sound source position information of the interactive audio through the input device 110. The panning device 120 acquires the user position information through a user position sensor 127. Here, the user position sensor acquires the user position information through various types of sensing devices (e.g., a camera, an infrared sensor, etc.). The panning device 120 receives the speaker position information from a storage device (not shown).

The relative position information determiner 121 determines relative position information of a sound source of the interactive audio based on the user position by using position information of the sound source of the interactive audio and the user position information. In other words, the relative position information determiner 121 determines a position of the sound source of the interactive audio based on a user position sensed by the user position sensor 127. For example, if the position of the sound source of the interactive audio is in (x, y, z) based on a reference point (0, 0, 0), and the user is positioned in (a, b, c) based on an arbitrary reference point, the relative position information determiner 121 determines the relative position of the sound source of the interactive audio as (a+x,b+y,c+z).

The panning coefficient analyzer 123 analyzes a panning coefficient of the sound source based on the user position by using the sensed user position information and speaker position information. In detail, the panning coefficient analyzer 123 determines the panning coefficient according to a position of a speaker based on an arbitrary point. Here, the panning coefficient may be mapped with the position of the sound source on a one-to-one basis and then stored in a table form. The panning coefficient analyzer 123 converts a panning coefficient table for the arbitrary point into a panning coefficient table that is based on the position of the user, to analyze an optimal panning coefficient table.

The 3D panning device 125 pans the interactive audio in a 3D space by using the relative position information of the sound source output from the relative position information determiner 121 and panning coefficient table output from the panning coefficient analyzer 123. In detail, if the audio apparatus 100 is realized as a plurality of speakers for outputting a plurality of channels having different elevation elements, the 3D panning device 125 applies a relative 3D position of the sound source of the interactive audio to the panning coefficient table to pan the interactive audio. Here, the 3D panning device 125 pans an audio signal into a 3D space by using a Vector Base Amplitude Panning (VBAP) method. Here, the VBAP method refers to a method of playing a virtual sound source inside a space formed by speakers by using a speaker group formed of two or three speakers.

However, according to another exemplary embodiment of the present general inventive concept, if the audio apparatus 100 is realized as a plurality of speakers having the same elevation elements, the 3D panning device 125 may pan the audio signal so that the audio signal includes a virtual elevation element, by using the plurality of speakers. Here, the audio apparatus 100 may use an upper speaker system to output the audio signal having the virtual elevation element by using the plurality of speakers having the same elevation elements. In detail, the upper speaker system is a speaker system capable of performing sound focusing. The upper speaker system may perform sound focusing through an ultrasonic speaker having a strong linearity, may perform beam forming through a speaker array to perform sound focusing, or may use a coloration filter according to an elevation based on a psychoacoustic. An audio, which is played through the upper speaker system, is reflected through the ceiling or a particular reflective surface to be transmitted to the user, and a frequency characteristic, which is generated if a sound image has an elevation, is transmitted and the user feels like he/she hears a sound from above.

The panning device 120 pans the interactive audio into a 3D space according to a method as described above and outputs the panned interactive audio to the renderer 130.

The renderer 130 renders the interactive audio according to a characteristic of a space (hereinafter referred to as space information of the main audio) realized by the main audio. In detail, the renderer 130 digitizes the space characteristic of the main audio in an ambience index and reflects the ambience index to render the interactive audio. Here, the ambience index corresponds to a reverberation time at which the interactive audio reverberates in a space and which is digitized and may be changed according to the space characteristic of the main audio. For example, if the space realized by the main audio is a cave, the interactive audio reverberates for a long time, and thus the ambience index is great. If the space realized by the main audio is outdoor, the interactive audio reverberates for a short time, and thus the ambience index is small.

As in the above-described exemplary embodiment of the present general inventive concept, if the space characteristic of the main audio is realized from the ambience index, a multi-reverberation is calculated as an impulse response or a transfer function. However, a value matching with the ambience index is selected from values of the impulse response or the transfer function stored in the renderer 130 and then is reflected on the interactive audio.

There may be used a method of directly reading and reflecting an impulse response or a transfer function that is not a digitized ambience index. In detail, if an impulse response or a transfer function is calculated for a space, the impulse response or the transfer function convolutes into the interactive audio in a time domain or a block convolution is executed to reflect the corresponding space characteristic on the interactive audio.

The renderer 130 may acquire the space characteristic of the main audio according to various methods. A method of acquiring the space characteristic of the main audio through the renderer 130 will now be described with reference to FIGS. 3 and 4.

Figure 3:
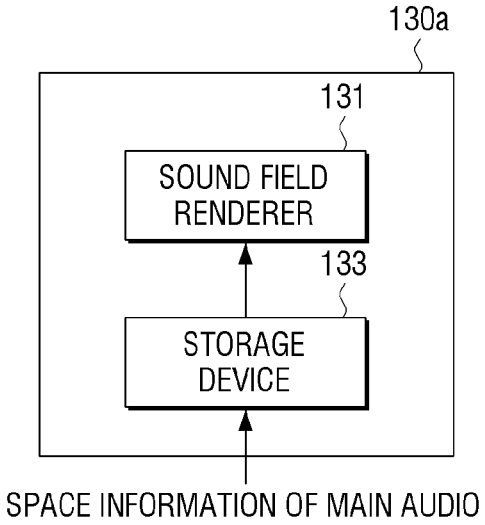
FIG. 3 is a block diagram illustrating a structure of a renderer according to an exemplary embodiment of the present general inventive concept.

FIG. 3 is a block diagram illustrating a structure of the renderer 130*a* according to an exemplary embodiment of the present general inventive concept. Referring to FIG. 3, the renderer 130*a* includes a sound field renderer 131 and a storage device 133. Here, the storage device 133 receives and stores space information of the main audio when the main audio is input. For example, the storage device 133 reads the space information of the main audio digitized as the ambience index from a media (e.g., streaming media from an internet source, a digital versatile disc (DVD), or a Blue-ray disc (BD), etc.), which streams/stores a multimedia content, and streams/stores the space information. The sound field renderer 131 renders the interactive audio by using the space information of the main audio stored in the storage device 133.

Figure 4:
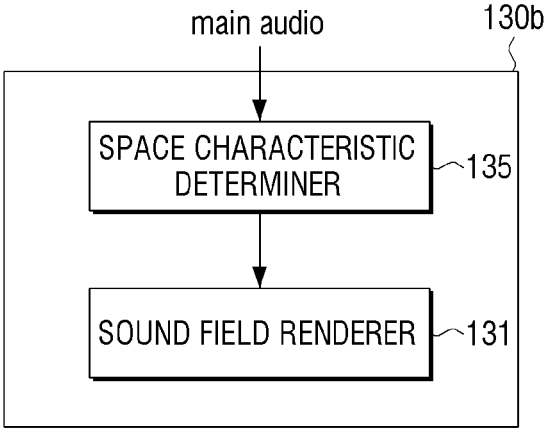
FIG. 4 is a block diagram illustrating a renderer according to another exemplary embodiment of the present general inventive concept.

FIG. 4 is a block diagram illustrating a structure of the renderer 130*b* according to another exemplary embodiment of the present general inventive concept. Referring to FIG. 4, the renderer 130*b* includes a sound field renderer 131 and a space characteristic determiner 135. Here, the space characteristic determiner 135 analyzes the input main audio to analyze the space characteristic of the main audio. In detail, the space characteristic determiner 135 analyzes a characteristic of the main audio to determine the space information realized by the main audio and generates an ambience index or an impulse response corresponding to the ambience index based on the determined space information. For example, the space characteristic determiner 135 analyzes the reverberation time of the main audio to generate the ambience index of the main audio. The sound field renderer 131 reflects the space information of the main audio determined by the space information determiner 135 to render the interactive audio. In particular, the renderer 130*b* of FIG. 4 may be applied to past manufactured media, which do not store the space information of the main audio.

The output device 140 outputs the main audio and the interactive audio rendered by the renderer 130. Here, the output device 140 may include a mixer (not shown) which mixes the main audio and the interactive audio rendered by the renderer 130.

As described above, the audio apparatus 100 provides an interactive audio according to a position of a user, a position of a speaker, and a space characteristic of a main audio. Therefore, the user further livelily hears the interactive audio A method of processing an audio signal of the audio apparatus 100 will now be described with reference to FIG. 5.

Figure 5:
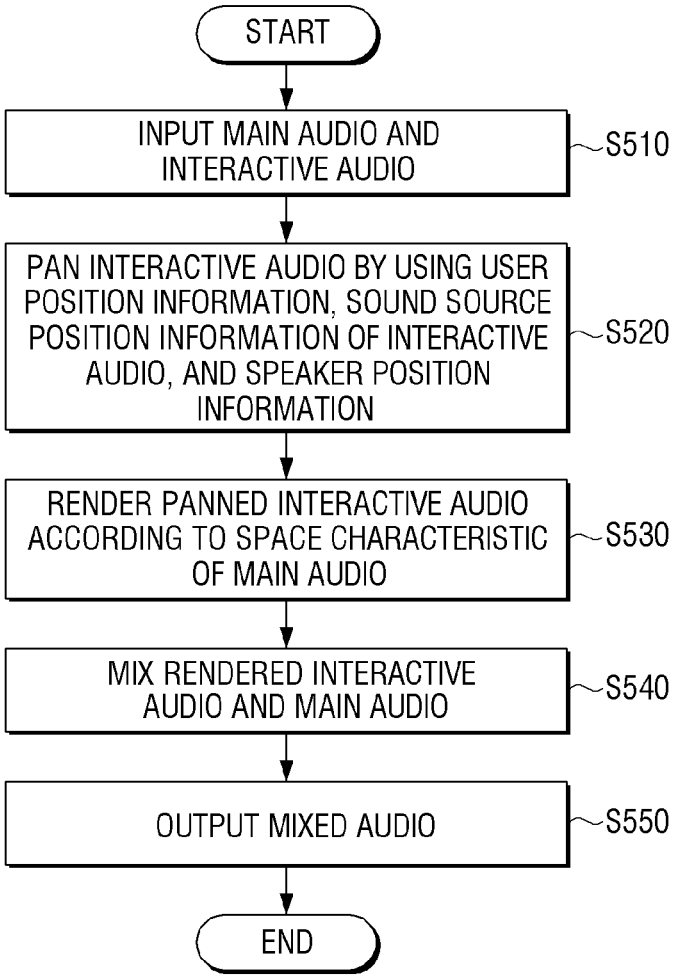
FIG. 5 is a flowchart illustrating a method of processing an audio signal according to an exemplary embodiment of the present general inventive concept.

Referring to FIG. 5, in operation S510, the audio apparatus 100 receives a main audio and an interactive audio. Here, the main audio may be an audio which is output regardless of a user command when a multimedia content is executed. The interactive audio may be an audio which is output in response to the user command when the multimedia content is executed.

In operation S520, the audio apparatus 100 pans the interactive audio by using position information of a user, sound source position information of the interactive audio, and speaker position information. In detail, the audio apparatus 100 determines a relative position of a sound source of the interactive audio based on the user position by using position information of the user and the sound source position information of the interactive audio. The audio apparatus 100 analyzes an optimal panning coefficient table based on the position information of the user and the position information of the speaker. The audio apparatus 100 applies the relative position of the sound source of the interactive audio to the panning coefficient table to pan the interactive audio. Here, the audio apparatus 100 pans the interactive audio as a 3D space so that the interactive audio is output through speakers having different elevation elements.

In operation S530, the audio apparatus 100 renders the panned interactive audio according to a space characteristic of the main audio. Here, the space characteristic of the main audio may be digitized as an ambience index, but the present general inventive concept is not limited thereto. For example, if an impulse response or a transfer function is calculated for a space, the impulse response or the transfer function convolutes into the interactive audio in a time domain or a block convolution is executed to reflect the corresponding space characteristic on the interactive audio. Therefore, the space characteristic of the main audio may be realized as an impulse response or a transfer function. The audio apparatus 100 receives space information of the main audio together when the main audio is input, stores the space information of the main audio in the storage device 133, and analyzes the main audio to determine the space information of the main audio.

In operation S540, the audio apparatus 100 mixes the rendered interactive audio and the main audio. In operation S550, the audio apparatus 100 outputs the mixed audio through a plurality of speakers.

As described above, according to a method of processing an audio signal, a user receives an interactive audio having an improved liveness according to a position of the user and a space realized by a main audio.

A method of processing an audio signal of an audio apparatus according to the above-described various exemplary embodiments of the present general inventive concept may be realized as a program and provided to a display apparatus.

In detail, there may be provided a non-transitory computer-readable medium which stores a program to implement the following: receiving a main audio and an interactive audio; panning the interactive audio by using position information of a user, sound source position information of the interactive audio, and speaker position information; rendering the panned interactive audio according to a space characteristic of the main audio; and mixing and outputting the rendered interactive audio and the main audio.

The non-transitory computer readable medium refers to a medium which does not store data for a short time such as a register, a cache memory, a memory, or the like but semi-permanently stores data and is readable by a device. In detail, the above-described applications or programs may be stored and provided on a non-transitory computer readable medium such as a CD, a DVD, a hard disk, a blue-ray disk, a universal serial bus (USB), a memory card, a ROM, or the like.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of processing a multimedia content reproduced by an audio apparatus, the method comprising:

receiving a main audio which is output regardless of a user input when executing the multimedia content, and an interactive audio which is output in response to the user input when executing the multimedia content;

panning the interactive audio by using position information of a user, sound source position information of the interactive audio, and speaker position information;

rendering the panned interactive audio according to a space characteristic of the received main audio; and mixing and outputting the rendered interactive audio and the received main audio to a plurality of speakers, wherein when rendering the panned interactive audio, the panned interactive audio is rendered according to a space characteristic of the received main audio which is determined by analyzing a reverberation time of the received main audio, and wherein the audio apparatus is realized as by the plurality of speakers for outputting a plurality of channels having different elevation elements, and the interactive audio is panned as a 3-dimensional (3D) space having an elevation element.

2. The method of claim 1, wherein the panning of the interactive audio comprises:

sensing the position information of the user;

determining relative position information of a sound source of the interactive audio based on the user by using the sensed position information of the user and a position of the sound source of the interactive audio;

analyzing a panning coefficient of the sound source based on the user position by using the sensed position information of the user and the speaker position information; and panning the interactive audio as the 3D space having the elevation component based on the panning coefficient of the sound source according to the relative position information of the sound source of the interactive audio.

3. The method of claim 1, wherein, when receiving the main audio and the interactive audio, space information of the main audio is received together, and wherein, when rendering the panned interactive audio, the panned interactive audio is rendered by using the space information of the received main audio.

4. The method of claim 3, wherein the space information of the received main audio is an impulse response or a transfer function.

5. An audio apparatus comprising:

an input device to receive a main audio which is output regardless of a user input when executing multimedia content, and an interactive audio which is output in response to the user input when executing the multimedia content;

a panning device to pan the interactive audio by using position information of a user, position information of a sound source of the interactive audio, and speaker position information;

a renderer to render the panned interactive audio according to a space characteristic of the received main audio; and an output device to mix and output the rendered interactive audio and the received main audio to a plurality of speakers, wherein the renderer comprises a space characteristic determiner to analyze a reverberation time of the received main audio to determine the space characteristic of the received main audio, and wherein the renderer is adapted to render the panned interactive audio according to the space characteristic of the received main audio determined by the space characteristic determiner, and wherein the audio apparatus is realized as by the plurality of speakers to output a plurality of channels having different elevation elements, and the panning device pans the interactive audio as a 3D space having an elevation element.

6. The audio apparatus of claim 5, wherein the panning device comprises:

a user position sensor to sense the position information of the user;

a relative position information determiner to determine relative position information of the sound source of the interactive audio based on the user position by using the position information of the user sensed by the user position sensor and a position of the sound source of the interactive audio;

a panning coefficient analyzer to analyze a panning coefficient of the sound source based on the user position by using the position information of the user and the speaker position information; and a 3D panning device to pan the interactive audio as the 3D space having the elevation component based on the panning coefficient of the sound source according to the relative position information of the sound source of the interactive audio.

7. The audio apparatus of claim 5, wherein the input device receives space information of the main audio, and wherein the renderer renders the panned interactive audio by using the space information of the received main audio.

8. The audio apparatus of claim 7, wherein the space information of the received main audio is an impulse response or a transfer function.

* * * * *